US009124003B2

(12) United States Patent
Jenwatanavet

(10) Patent No.: US 9,124,003 B2
(45) Date of Patent: Sep. 1, 2015

(54) MULTIPLE ANTENNA SYSTEM

(71) Applicant: QUALCOMM Incorporated, San Diego, CA (US)

(72) Inventor: Jatupum Jenwatanavet, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 142 days.

(21) Appl. No.: 13/773,626

(22) Filed: Feb. 21, 2013

(65) Prior Publication Data

US 2014/0232612 A1 Aug. 21, 2014

(51) Int. Cl.

| | |
|---|---|
| ***H01Q 1/24*** | (2006.01) |
| ***H01Q 1/52*** | (2006.01) |
| ***H01Q 9/04*** | (2006.01) |
| ***H01Q 9/42*** | (2006.01) |

(52) U.S. Cl.

CPC ..... *H01Q 1/525* (2013.01); *H01Q 1/521* (2013.01); *H01Q 9/0421* (2013.01); *H01Q 9/42* (2013.01)

(58) Field of Classification Search

CPC ..... H01Q 1/521; H01Q 1/525; H01Q 9/42
USPC ..... 343/700 MS, 702, 825, 829, 846
See application file for complete search history.

(56) References Cited

U.S. PATENT DOCUMENTS

| | | | | |
|---|---|---|---|---|
| 6,861,990 | B2 * | 3/2005 | Hung et al. | 343/702 |
| 6,952,187 | B2 * | 10/2005 | Annamaa et al. | 343/702 |
| 7,369,091 | B2 | 5/2008 | Man et al. | |
| 7,768,462 | B2 | 8/2010 | Zhang et al. | |
| 8,284,116 | B2 * | 10/2012 | Hwang et al. | 343/860 |
| 8,890,754 | B2 * | 11/2014 | Lin et al. | 343/702 |
| 8,981,999 | B2 * | 3/2015 | Liu et al. | 343/700 MS |
| 2008/0198082 | A1 | 8/2008 | Soler Castany et al. | |
| 2009/0009401 | A1 | 1/2009 | Suzuki et al. | |
| 2009/0058731 | A1 | 3/2009 | Geary et al. | |
| 2009/0073047 | A1 | 3/2009 | Le Bolzer et al. | |
| 2009/0284433 | A1 | 11/2009 | Tsutsumi et al. | |
| 2012/0013522 | A1 | 1/2012 | Yamaguchi et al. | |

FOREIGN PATENT DOCUMENTS

WO 2013010145 A1 1/2013

OTHER PUBLICATIONS

International Search Report and Written Opinion—PCT/US2014/017164—ISA/EPO—Apr. 28, 2014.

* cited by examiner

*Primary Examiner* — Tho G Phan
(74) *Attorney, Agent, or Firm* — The Marbury Law Group, PLLC

(57) ABSTRACT

A multiple antenna module suitable for use in small sized mobile computing devices includes at least a first antenna extending beyond a lateral edge of and coplanar with a printed circuit board assembly and connected to the printed circuit board assembly via a first antenna ground contact and a first antenna feed contact. The multiple antenna module also includes a second antenna located proximate to the first antenna and configured in a plane perpendicular to the plane continuing the first antenna and the printed circuit board. The second antenna is connected to the printed circuit board assembly via a second antenna ground contact and a second antenna feed contact in which the second antenna ground contact and second antenna feed contact are connect to the printed circuit between the first antenna ground contact and the first antenna feed contact.

20 Claims, 17 Drawing Sheets

MULTIPLE ANTENNA SYSTEM

FIELD

The present application relates to a multiple antenna system, and more particularly to an antenna system having multiple antennas that efficiently utilize space in a mobile wireless device.

BACKGROUND

Mobile computing devices have seen explosive growth over the past few years. With growing computational power and memory capacity, personal mobile computing devices, have become essential tools of modern life, providing telephone and text communications, navigation, photo and video functionality in a package that fits in one's pocket. As a result of providing so many different types of radio frequency communications services and displaying high-quality video, many smart phones and similar mobile computing devices now require multiple antennas capable of transmitting and receiving (i.e., "transceiving") radio signals over a variety of wireless networks and associated bandwidths. However, the operation of multiple antennas often requires that the antennas be isolated some distance away from one another to avoid interference or antenna coupling. In smaller sized mobile computing devices, such as the size of a wristwatch, the limited real estate prevents the effective implementation of multiple antennas without resulting in antenna coupling. Without such isolation, the mobile computing device may not operate properly as the presence of the other antennas creates performance degradation in the form of antenna coupling, even though some of the antennas are not energized at the same time in the operation modes.

Some conventional devices have attempted to provide a single antenna configured to transceive radio signals over multiple wireless networks and multiple frequency bands. However, such devices with a singular antenna serving multiple wireless networks and frequency bands often provide sub-optimal performance in each of multiple wireless networks and bandwidths. In order to allow a singular antenna to service all of the desired bandwidths and wireless networks, additional circuitry is required to distinguish radio signals for each of the desired wireless networks and frequency bands. Such additional circuitry may increase the total cost, power consumption and volume of the mobile computing device. Moreover, a singular antenna prohibits the capability of having simultaneous operation of radio functionality in different frequency bands.

SUMMARY

The various embodiments include a multiple antenna system that provides multiple antennas capable of transmitting and receiving ("transceiving") radio signals over a variety of communication protocols and over a variety of frequency bands. The multiple antenna system may include a first antenna configured to transceive radio signals over a first communication network (e.g., WWAN network). The multiple antenna system may also include a second antenna configured to transmit and/or receive radio signals over/from a second communication network (e.g., GPS, a personal area network, etc.).

In embodiments, the multiple antenna system may provide multiple antennas in close proximity to one another in a unique configuration which may minimize the problems of antenna coupling without the need for additional RF components while improving gain and efficiency performance of each of the multiple antennas.

In a first embodiment, a printed circuit board may be formed in a first horizontal plane and may act as a ground plane for each antenna that forms the multiple antenna system. A first antenna may be configured in the same horizontal plane as the printed circuit board. The first antenna may be a Planar Inverted F Antenna (PIFA). The first antenna may be coupled to the printed circuit board through a first antenna ground contact and a first antenna feed contact. The first antenna feed contact may be used to energize the first antenna with radio signals such that radio frequency (RF) electromagnetic radiation signals may be transmitted over a first wireless network for receipt by another device. A second antenna may be configured in a vertical plane perpendicular to the horizontal plane in which the printed circuit board and first antenna are positioned. The second antenna may also be a PIFA. The second antenna may be coupled to the printed circuit board through a second antenna ground contact and a second antenna feed contact. The second antenna feed contact may be used to energize the second antenna with radio signals such that RF electromagnetic radiation signals may be transmitted over a second wireless network for receipt by another device. The embodiment multiple antenna system may be configured with the first antenna and second antenna in close proximity to one another such that the second antenna ground and feed contacts coupling the second antenna to the printed circuit are positioned between the first antenna ground and first antenna feed contacts of the first antenna.

In a second embodiment, the compact multiple antenna system of the first embodiment may be contained within an enclosed module unit to decouple the multiple antenna system from other electrical components (e.g., LCD, microphone, loud speaker, motor vibrator, etc.) within a wireless device. In addition, the enclosed module unit may be equipped with electrical couplings that allow the enclosed module unit to snap into place for quick electrical connection with a printed circuit board of a wireless device. A variety of compact multiple antenna module units may be manufactured with the first antenna and second antenna configured with different dimensions and may be manufactured to enable integration of the antenna modules with mobile devices with printed circuit boards of various sizes, since the length of each antenna and the printed circuit board operating as its ground plane should be at least one half the wavelength of the RF signals being transmitted. In an embodiment, the same module unit may be used for printed circuit boards of various sizes. In order to account for the cariation in ground plane dimensions, the module unit may include a matching circuit. The matching circuit may help adjust the resonant frequency to the expected frequency in case that the total length of antenna in the module unit and the printed circuit board is far from one half the wavelength.

BRIEF DESCRIPTION OF THE DRAWINGS

The accompanying drawings are presented to aid in the description of embodiments of the disclosure and are provided solely for illustration of the embodiments and not limitation thereof.

DETAILED DESCRIPTION

Figure 1:
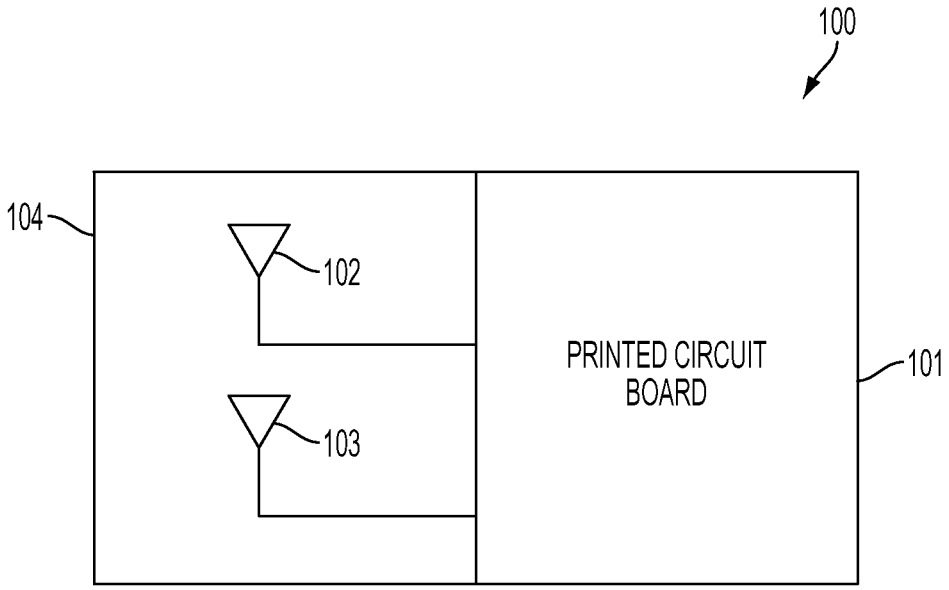
FIG. 1 is a component block diagram of a mobile computing device comprising multiple antennas.

The various embodiments will be described in detail with reference to the accompanying drawings. Wherever possible, the same reference numbers will be used throughout the drawings to refer to the same or like parts. References made to particular examples and implementations are for illustrative purposes, and are not intended to limit the scope of the disclosure or the claims. Alternate embodiments may be devised without departing from the scope of the disclosure. Additionally, well-known elements of the disclosure will not be described in detail or will be omitted so as not to obscure the relevant details of the disclosure.

The words "exemplary" and/or "example" are used herein to mean "serving as an example, instance, or illustration." Any embodiment described herein as "exemplary" and/or "example" is not necessarily to be construed as preferred or advantageous over other embodiments.

The word "approximately" as used herein with respect to certain dimensions means within ten percent of the dimension, including within five percent, within two percent and within one percent of the corresponding dimension.

As used herein, the terms "computing device" and "mobile computing device" refer to any one or all of cellular telephones, smart phones, personal data assistants (PDA's), palm-top computers, tablet computers, notebook computers, personal computers, wireless electronic mail receivers, multimedia Internet enabled cellular telephones, and similar electronic devices which include multiple programmable processors, and memory.

Currently, processors used in mobile communication devices have decreased in size while becoming ever more powerful. This is led to efforts by mobile device manufacturers to reduce the size of their wireless communication devices. Development of ever smaller wireless communication devices has been limited, however, due to limitations in antenna sizes achievable in small packages due to antenna coupling. The phenomenon of antenna coupling occurs when RF energy from one antenna excites a nearby antenna, thereby draining some of the energy from the radiated signal. The losses due to antenna coupling occurs even if the other antenna(s) is not in use (i.e. its radio circuit is not energized).

Also, increased demand for mobile computing devices with multiple wireless connectivity and radiofrequency components has increased the demand for multiple types of antennas capable of receiving and transmitting RF signals over a variety of frequency bands. Of course, mobile communication devices configured to communicate on cellular telephone networks (e.g., CDMA, TDMA, 3G, 4G, LTE, UTMS, etc.) include cellular radio transceivers and associated antennas. For example, global positioning system (GPS) are becoming common components as demands for location-based services increase. As another example, most wireless communication devices now incorporate short-range radios, such as Bluetooth, that support short-range personal area networks (PAN). As a further example, many mobile communication devices also are configured to receive Wi-Fi network RF signals. All of these different types of radios receive and transceivers RF signals within different frequency bands, and thus require different sized antennas. Fitting all of these types of antennas within the confined space of a typical wireless communication device without losing performance due to antenna coupling is a difficult design challenge, which is made more difficult as the size of the device is reduced.

In order to provide mobile computing devices with the ability to communicate over several different wireless networks, some conventional mobile computing devices include a single antenna configured to transceive radio signals over the variety of frequency bands used by the different types of wireless networks. Some mobile computing devices include multiple antennas each of which is configured to transceive radio signals over one frequency band. By having multiple antennas incorporated into the conventional device, communications over each of these wireless networks may be made possible.

However, conventional mobile computing devices that include a single antenna serving multiple protocols and frequency bands often exhibit sub-optimal performance in at least some of the frequency bands. A singular antenna limits the ability of the communication device to support simultaneous operations in different frequency bands. In addition, in order to allow a singular antenna to service all of the wireless networks, additional circuitry is typically required, which increases cost, power consumption and total volume is required. Example of such additional circuitry include additional RF components, such as RF switches, triplexers, extractor, and filters. The addition of such components increases the overall cost and size of the transceiver stage. Further, each of these RF components introduce RF losses and increased battery drain, reducing the effective range of the antenna and/or the power required to run the radio, and reducing the device battery life.

In conventional mobile computing devices where multiple antennas are implemented, the multiple antennas are spaced apart to limit interference or antenna coupling. This places a size limit on conventional devices in order to provide the necessary space and volume to isolate each of the multiple antennas. In smaller sized mobile computing devices, such as the size of a wristwatch, the limited real estate limits opportunities for implementing multiple antennas to support multiple radio circuits due to antenna coupling within the small volume.

For these reasons, compact antenna designs that limit antenna coupling among antennas for different wireless networks, such as cellular telephone, Bluetooth®, Wi-Fi, and GPS are desirable since they enable smaller communication devices. The larger the number of frequency bands that can be supported by compact antenna designs the better since this enables more types of wireless services and operations in more geographic locations. It is also desirable to reduce the size ("real estate") of printed circuit boards by requiring fewer RF components in order to support smaller and more economical mobile computing devices.

The various embodiments provide a compact set of antennas suitable for incorporation within the footprint of a small mobile computing device that exhibit efficient broad spectrum antenna performance. The embodiments enable a small sized mobile computing device with multiple antennas in close proximity to one another in a unique configuration that minimizes problems of antenna coupling without additional RF components while improving gain and efficiency of each of the multiple antennas.

FIG. 1 is a component block diagram of an embodiment mobile computing device including an embodiment multiple antenna system. As shown in FIG. 1, a mobile computing device 100 may include a printed circuit board 101 on which are placed various electronic circuits of the mobile computing device 100. An embodiment multiple antenna system module 104 is coupled to the printed circuit board 101. The embodiment multiple antenna system module 104 may include a first antenna 102 and a second antenna 103. The first antenna 102 and second antenna 103 may each be a Planar Inverted F Antenna (PIFA). The first antenna 102 may be configured to transceive radio signals over a first wireless network using a wireless protocol, such as a Wireless wide area network (WWAN) that uses mobile telecommunication cellular network technologies. Examples of mobile telecommunication cellular network technologies include, for example, CDMA, 3G, 4G, LTE, WiMAX (often called a wireless metropolitan area network or WMAN), UMTS, CDMA 2000, GSM cellular digital packet data (CDPD) and Mobitex wireless networks. The second antenna 103 may be configured to transceive radio signals of a second wireless network, such as a Personal Area Network (PAN) wireless protocol, Bluetooth®, ANT, Peanut®, and Zigbee®. Alternatively, the second antenna 103 may be configured to receive GPS signals from the Global Positioning System. As described in more detail below, the multiple antenna system module 104 may be configured as an "off-the-shelf" module that contains a first antenna 102 and second antenna 103 configured to operate in conjunction with a printed circuit board 101 of particular dimensions. Thus, the multiple antenna system module 104 may contain a first antenna 102 and second antenna 103 that may be sized and configured to transceive radio signals in particular frequency bands when mated to printed circuit board 101 of specific dimensions since the printed circuit board acts as the antenna ground planes. In this manner, the appropriate "off-the-shelf" multiple antenna system module 104 may be quickly selected for coupling to a printed circuit board 101 when the dimensions of the printed circuit board are defined. Moreover, the existing multiple antenna system module 104 may be integrated with printed circuit boards of various sizes. In such embodiments, the multiple antenna system module 104 or printed circuit board 101 may further be provided with a matching circuit (not shown) which may adjust the resonant frequency to the desirable frequency.

Figure 2:
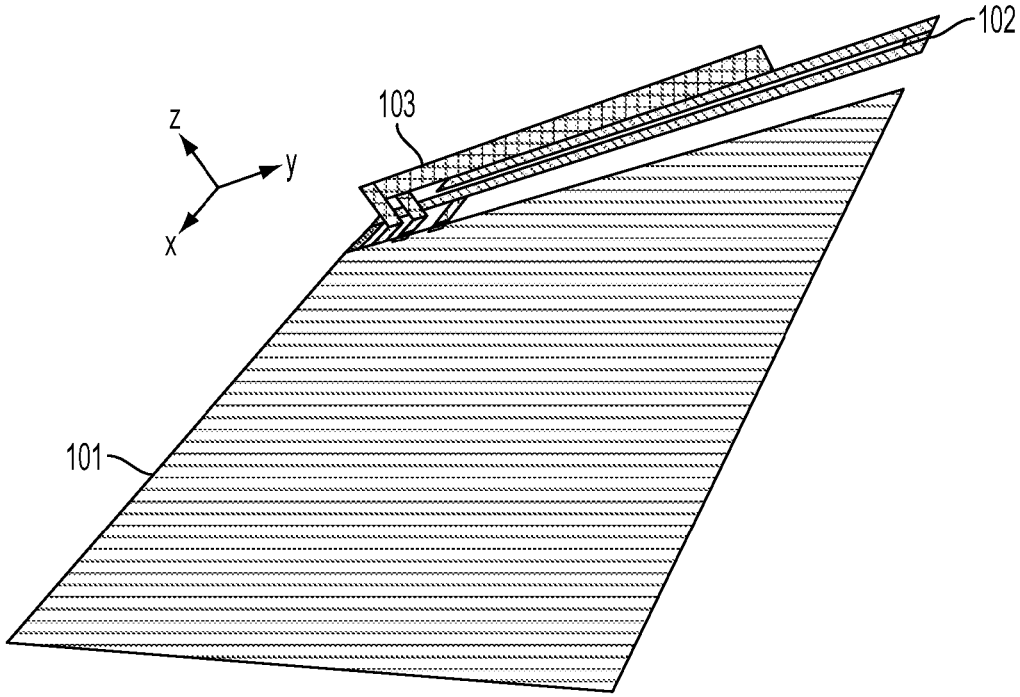
FIG. 2 is a first perspective view of an embodiment multiple antenna system.

FIG. 2 is a perspective view of a printed circuit board 101 and an embodiment multiple antenna system having a first antenna 102 and a second antenna 103 coupled to the printed circuit board 101. As shown more clearly in FIGS. 4-7, the first antenna 102 is configured so that it is in the same plane (x-y plane) as the printed circuit board 101, while the second antenna 103 is configured so that it is in a plane (y-z plane) perpendicular to the plane (x-y plane) of the printed circuit board 101 and first antenna 102. FIG. 2 also illustrates how the feed and ground contacts for the second antenna 103 coupled to the printed circuit board 101 between the feed and ground contacts of the first antenna 102. This feed and ground coupling configuration is discussed below and illustrated more clearly in FIGS. 4-7.

Figure 3:
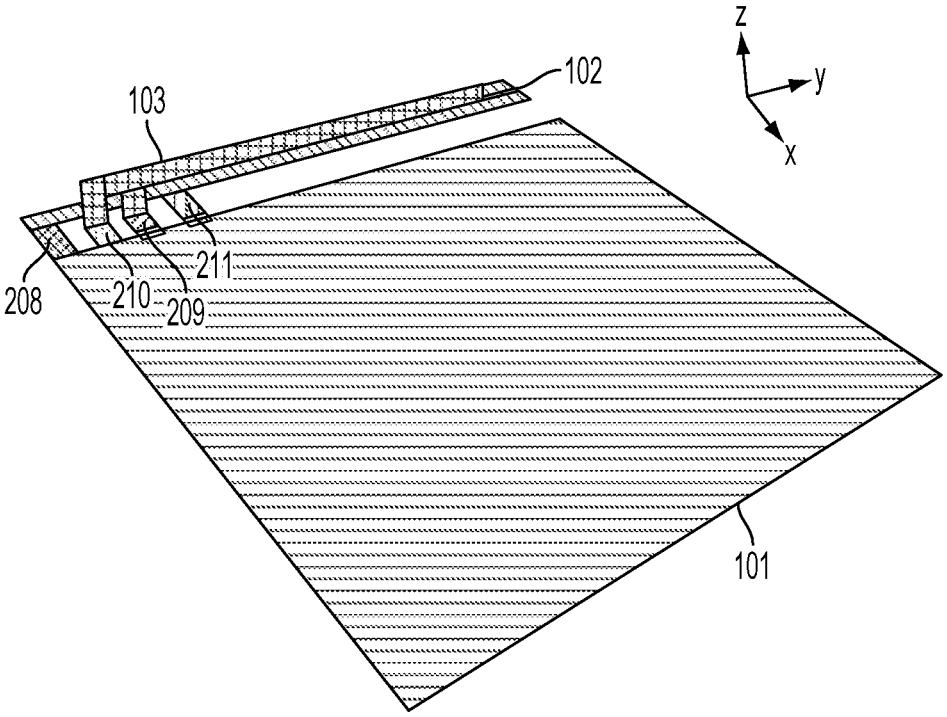
FIG. 3 is a second perspective view of an embodiment multiple antenna system.

FIG. 3 is a second perspective view of the printed circuit board 101 and the embodiment multiple antenna system showing details of how the first antenna 102 and second antenna 103 couple to the printed circuit board 101. As shown in FIG. 3 (and in each of FIGS. 2-5, 8 and 9), the first antenna 102 is coupled to the printed circuit board 101 via a first antenna ground contact 208 and a first antenna feed contact 211, and the second antenna 103 is coupled to the printed circuit board 101 via a second antenna ground contact 210 and a second antenna feed contact 209, which are both positioned between the first antenna ground contact 208 in the first antenna feed contact 211. The antenna feed contacts 211, 209 provide a point at which the antenna is energized with electrical energy to generate an RF field. As shown in FIG. 3 (and in each of FIGS. 2-5, 8 and 9), in addition to positioning the second antenna ground contact 210 and second antenna feed contact 209 between the feeding ground contacts the first antenna 102, both the second antenna ground contact 210 and second antenna feed contact 209 are coupled to the printed circuit board 101 within close proximity to one another. While FIG. 3 illustrates the second antenna ground contact 210 and second antenna feed contact 209 as extending in the same horizontal plane (x-y plane) as the printed circuit board 101 and first antenna 102, the second antenna 103 may be configured in a vertical plane (y-z plane) perpendicular to the printed circuit board 101, and the first antenna 102.

The unique configuration illustrated in FIG. 3 of positioning the feed and ground contacts of the second antenna 103, which is configured perpendicular to the plane of the printed circuit board and the first antenna 102, between the feed and ground contact of the first antenna 102 results in closely spaced two antennas that exhibit a relatively small amount of antenna coupling.

Figure 4:
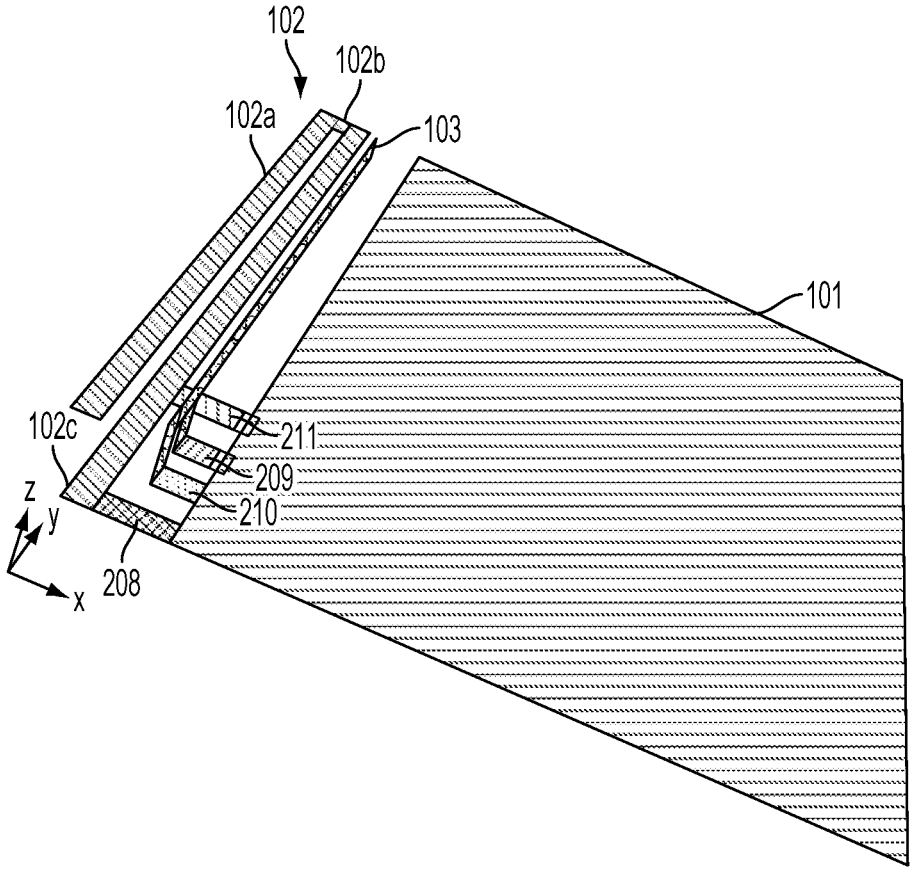
FIG. 4 is a third perspective view of an embodiment multiple antenna system.

FIG. 4. is a third perspective view showing the printed circuit board 101 and the embodiment multiple antenna system from another vantage point. As shown in FIG. 4 (and more clearly shown in FIG. 5), the first antenna 102 may be formed from multiple segments 102*a*, 102*b*, and 102*c*, thereby giving it a longer focal length than a width dimension of the printed circuit board 101. By forming the first antenna 102 from multiple segments, the necessary total length of the antenna may be achieved to enable transmission and reception of RF energy in a desired frequency band. In particular, antenna performance is improved when the cumulative lengths of the multiple segments forming the first antenna 102 plus the length of the printed circuit board 101 (which forms the ground plane) is at least one half wavelength of the RF signals to be received and transmitted. In order to support transmission and reception RF signals with different wavelengths, the first antenna 102 may be formed from more or fewer segments than illustrated in FIG. 4. Similarly, the second antenna 103 may also be formed of multiple segments to achieve a desired cumulative length, although the second antenna 103 is illustrated in the figures as including only a single segment.

Figure 5:
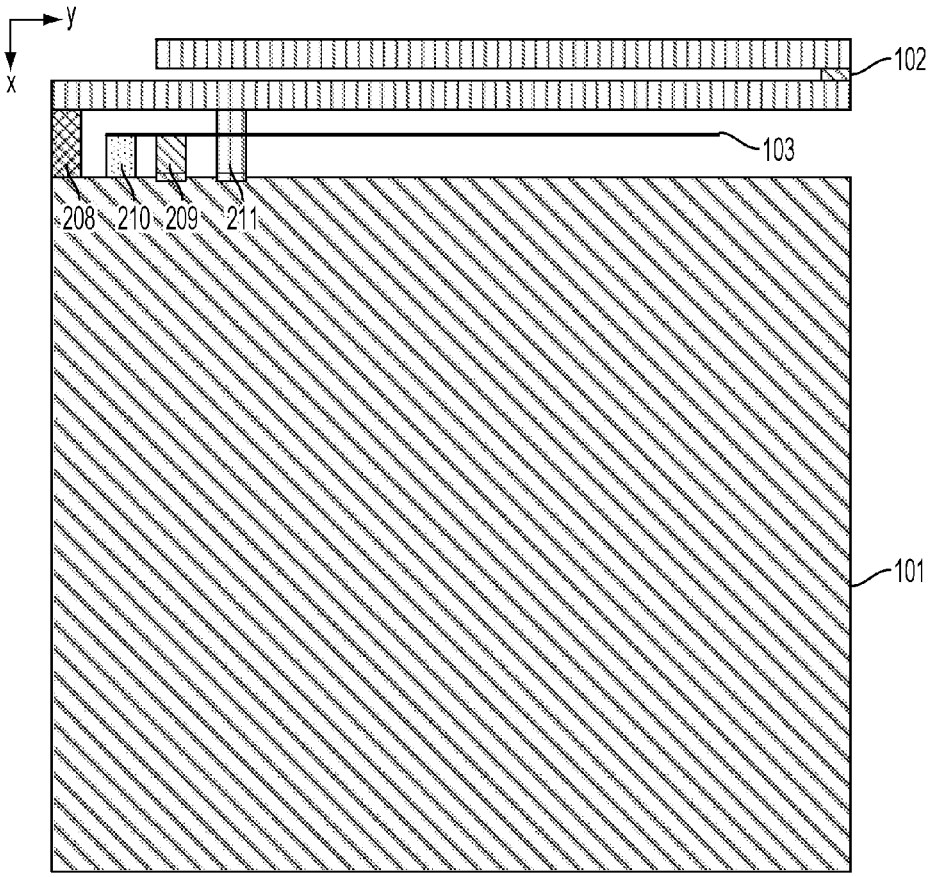
FIG. 5 is a top view of an embodiments multiple antenna system.

FIG. 5 is a top view of the embodiment multiple antenna system shown in FIGS. 2-4. FIG. 5 shows more clearly the positions of the feed and ground connections to the printed circuit board 101 of the first and second antenna. Specifically, the feed contact 209 and ground contact 210 of the second antenna 103 (i.e., the antenna perpendicular to the printed circuit board) are positioned in close proximity to and between the feed contact 211 and ground contact 208 of the first antenna 102 (i.e., the antenna parallel to the printed circuit board). FIG. 5 also shows the perpendicular orientation of the first and second antennas. While the printed circuit board 101 illustrated in FIG. 5 is square, as discussed below with respect to FIGS. 10A-10F, the printed circuit board 101 may be rectangular, polygon, circular or any arbitrary in shape.

The lengths of the first antenna 102 and second antenna 103 are functions of the wavelengths of RF signals that each antenna is designed to receive and the dimensions of the printed circuit board 101. The dimensions of the printed circuit board 101 and antenna 104 depend upon the physical size the communication device in which the assembly must fit. In order to insure that the multiple antenna system also fits within the confines of any housing containing the printed circuit board 101, the multiple antenna system may be formed such that its dimensions do not exceed the perimeter dimensions of the printed circuit board 101. For example, as shown in FIG. 5, the width of the multiple antenna system does not exceed the width of the printed circuit board 101. Thus, the spatial restrictions of the specific application for which the multiple antenna module is implemented dictate the specific dimensions of each antenna.

As discussed above, in some embodiments, the size and shape of the printed circuit board 101 may be such that the dimensions of the printed circuit board 101 are less than the length required for the first antenna 102 to properly transceive radio signals at the required frequency of the first wireless network. In order to configure the length of the first antenna 102 to provide the necessary half wavelength dimension, the first antenna 102 may be formed from multiple segments 102*a*, 102*b*, and 102*c* such that the multiple antenna module may still be contained within the perimeter of the printed circuit board 101. Moreover the matching circuit included in either the module unit 104 or on the printed circuit board 101 may adjust the resonant frequency without the need to increase the length and/or dimension of the antennas 102, 103.

By configuring the first antenna 102 and the second antenna 103 in a perpendicular configuration and in close proximity to one another, with the second antenna ground contact 210 and second antenna feed contact 209 couple to the printed circuit board 101 between the first antenna ground contact 208 and first antenna feed contact 211, the first antenna 102 and the second antenna 103 may operate simultaneously in a confined area without significant antenna coupling or cross talk effects. As discussed above, electrical energy may be injected into the first and second antennas 102, 103 at their respective feed contacts 209, 211. At these locations, the current density is at a maximum value, while the electrical field is at a minimum. Conversely, at the respective edges of each antenna structure, the current density is at a minimal value, while the electrical field is at a maximum density. Antenna coupling occurs where the electrical fields generated is at its maximum density. By positioning the first antenna feed contact 211 and the second antenna feed contact 209 in close proximity to one another, the electrical field generated in the areas in which the feed contact 209 of first antenna 102 and the feed contact 211 of second antenna 103 are in close proximity to one another may be minimized. Furthermore the respective edges of each antenna structure are in orthogonal planes and point in opposite direction so that the coupling of electric field is also minimized. This reduces the coupling between the two antennas. Configuring the first antenna 102 in a plane perpendicular the second antenna 103 also reduces the coupling between the two antennas.

Figure 6:
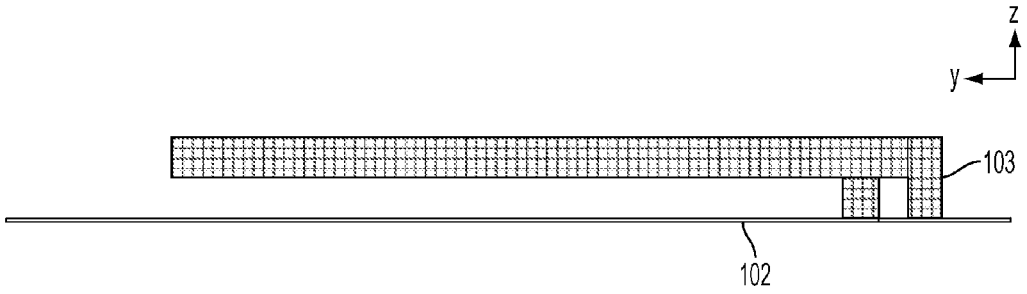
FIG. 6 is a first planar view of an embodiment multiple antenna system.
Figure 7:
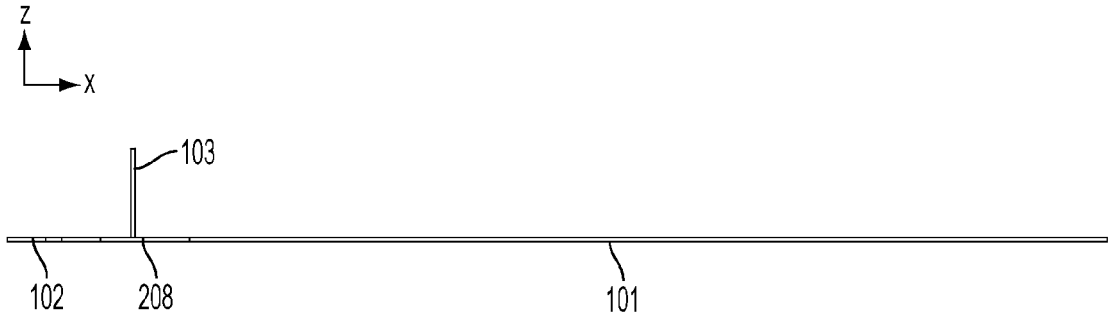
FIG. 7 is a second planar view of an embodiment multiple antenna system.

FIGS. 6 and 7 are side views of the multiple antenna system shown in FIGS. 2-5 as viewed along the plane of the printed circuit board and first antenna 102. FIGS. 6 and 7 illustrate the perpendicular orientation of the second antenna with respect to the first antenna and the printed circuit board. Since the view in FIG. 6 is along the x-axis, only the edge of the first antenna 102 is visible. In the side-view of FIG. 7 only the edges of the first antenna 102 and the second antenna 103 are visible. In addition, the edge of the first antenna ground contact 208 is visible.

Figure 8:
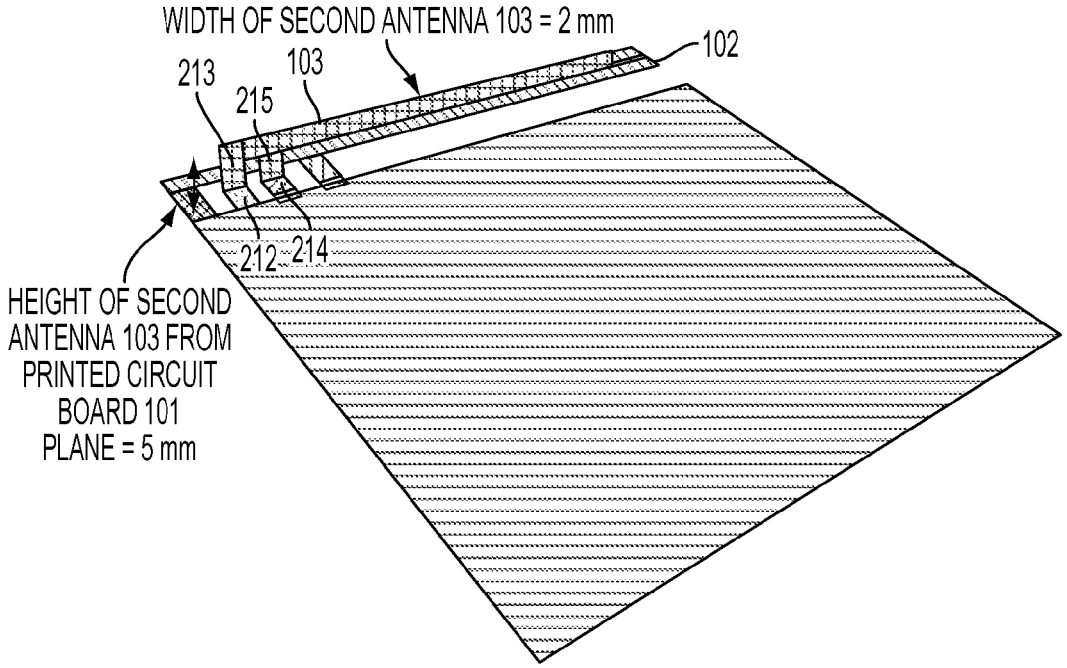
FIG. 8 is a second perspective view of an embodiment multiple antenna system showing example dimensions.

FIG. 8 is a perspective view of the multiple antenna system with dimensions of an example embodiment that may be implemented in a watch sized mobile computing device. As discussed above, the specific dimensions of the antenna components are dictated by the frequencies that the antenna are designed to receive and dimensions of the printed circuit board 101. Thus, while the illustrated dimensions are suitable for a particular implementation of the various embodiments, other implementations may have different components dimensions.

In the embodiment shown in FIG. 8, the width of the second antenna 103 may be approximately 2 mm. The second antenna 103 may be coupled to the printed circuit board 101 via a second antenna ground contact 210 and a second antenna feed contact 209. The second antenna ground contact 210 may be formed from a horizontal ground segment 212 and a vertical ground segment 213. The horizontal ground segment 212 may be formed in the horizontal plane (x-y plane) and may be approximately 2 mm in width and 3 mm in length to offset the second antenna 103 beyond the lateral edge of the printed circuit board 101. The vertical ground segment 213 may be formed in the vertical plane (y-z plane) and may be approximately 2 mm in width and 3 mm in length to offset the second antenna 103 vertically above the horizontal plane where the printed circuit board 101 and first antenna 102 may be disposed. Similarly, second antenna feed contact 209 may be formed from a horizontal ground segment 214 and a vertical feed segment 215. The horizontal ground segment 214 may be formed in the horizontal plane (x-y plane) and may be approximately 2 mm in width and 3 mm in length to offset the second antenna 103 beyond the lateral edge of the printed circuit board 101. The vertical feed segment 215 may be formed in the vertical plane (y-z plane) and may be approximately 2 mm in width and 3 mm in length to offset the second antenna 103 vertically above the horizontal plane where the printed circuit board 101 and first antenna 102 may be disposed. In addition, the second antenna 103 may be vertically offset from the horizontal plane (x-y plane) of the first antenna 102 and the printed circuit board 101 such that the top edge of the second antenna 103 may be approximately 5 mm above the first antenna 102. Thus, the bottom edge of the second antenna 103 may be vertically offset from the printed circuit board 101 and first antenna 102 by approximately 3 mm. It should be appreciated that references to horizontal, vertical, top and bottom in this description are for illustration purposes, are entirely arbitrary; the parallel and perpendicular relationships between the components being of significance.

Figure 9:
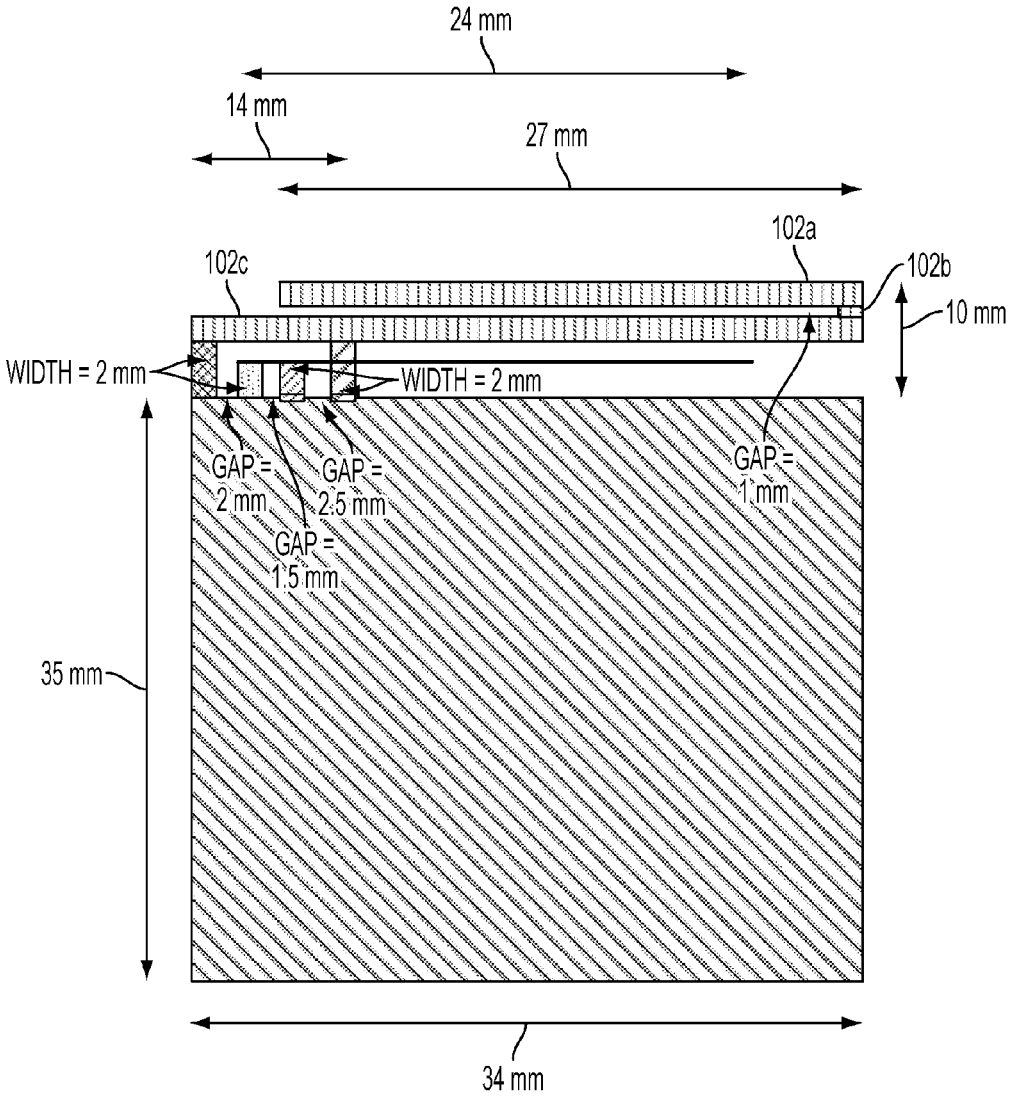
FIG. 9 is a top planar view of an embodiment multiple antenna system showing example dimensions.

FIG. 9 is a top view including dimensions of various components of an example embodiment multiple antenna system that may be implemented in a watch sized mobile computing device. In the embodiment shown in FIG. 9, the printed circuit board 101 may measure approximately 35 mm by approximately 34 mm. The first antenna 102 may be coupled to the printed circuit board 101 near a first corner of the printed circuit board 101 via a first antenna ground contact 208 and first antenna feed contact 211. The first antenna ground contact 208 and first antenna feed contact 211 may each be approximately 2 mm in width and may laterally offset the first antenna 102 from the printed circuit board 101 by approximately 5 mm. The interior edges of the first antenna ground contact 208 and the first antenna feed contact 211 may be separated by a distance of approximately 10 mm. The first antenna 102 may be formed of three segments 102*a*, 102*b*, and 102*c*. The first segment 102*a* may be approximately 2 mm in width and 27 mm in length. The second segment 102*b* may be approximately 1 mm in width and 2 mm in length. The third segment 102*c* may be approximately 2 mm in width and 34 mm in length.

The second antenna 103 may be coupled to the printed circuit board 101 near the first corner of the printed circuit board 101 via a second antenna ground contact 210 and second antenna feed contact 209. The second antenna ground contact 210 and the second antenna feed contact 209 may be separated from one another by a distance of approximately 1.5 mm. In addition, the second antenna ground contact 210 and the second antenna feed contact 209 may be configured to couple to the printed circuit board between the first antenna ground contact 208 and the first antenna feed contact 211. The second antenna ground contact 210 may be separated from the first antenna ground contact 208 by approximately 2 mm. The second antenna feed contact 209 may be separated from the first antenna feed contact 211 by approximately 2.5 mm. The second antenna 103 may be formed from a single segment that may be approximately 2 mm in width and 24 mm in length. As discussed above, the cumulative length of the first antenna 102 as well as the second antenna 103 may be dictated by the wavelength of signals to be transmitted and received by the respective antenna as well as the dimensions of the printed circuit board 101 acting as the ground plane. In the embodiment illustrated in FIG. 9, the first antenna ground contact 208, first antenna feed contact 211, second antenna ground contact 210 and second antenna feed contact 209 may be coupled within approximately 14 mm of the first corner of the printed circuit board 101 and one another.

As noted above, in alternative embodiments the printed circuit board 101 may configured to be arbitrary in shape. In such embodiments, the first antenna 102 and second antenna 103 may be configured to conform to the arbitrary shape of the printed circuit board 101. As in the previously disclosed embodiments, in such alternative embodiments the first antenna 102 may be formed in the same plane as the printed circuit board 101. The first antenna 102 may be laterally offset from an edge of the arbitrarily shaped printed circuit board 101. The second antenna 103 may be formed in a plane perpendicular to the plane containing the first antenna 102 and the arbitrary shaped printed circuit board 101. Both the first antenna 102 and the second antenna 103 of the alternative embodiments may be PIFA type antennas. The first antenna 102 may be coupled to the arbitrarily shaped printed circuit board 101 via a first antenna feed contact 211 and a first antenna ground contact 208. The second antenna 103 may be coupled to the arbitrarily shaped printed circuit board 101 via a second antenna feed contact 209 and a second antenna ground contact 210. As in the previously disclosed embodiments, in such alternative embodiments, the first antenna 102 may be coupled to the printed circuit board 101 in close proximity to the location in which the second antenna 103 is coupled to the printed circuit board 101. In addition, the second antenna feed contact 209 and second antenna ground contact 210 may couple the second antenna 103 to the printed circuit board 101 in a location between the points that the first antenna feed contact 208 and first antenna ground contact 211 couple the first antenna 102 to the printed circuit board 101.

Figure 10A:
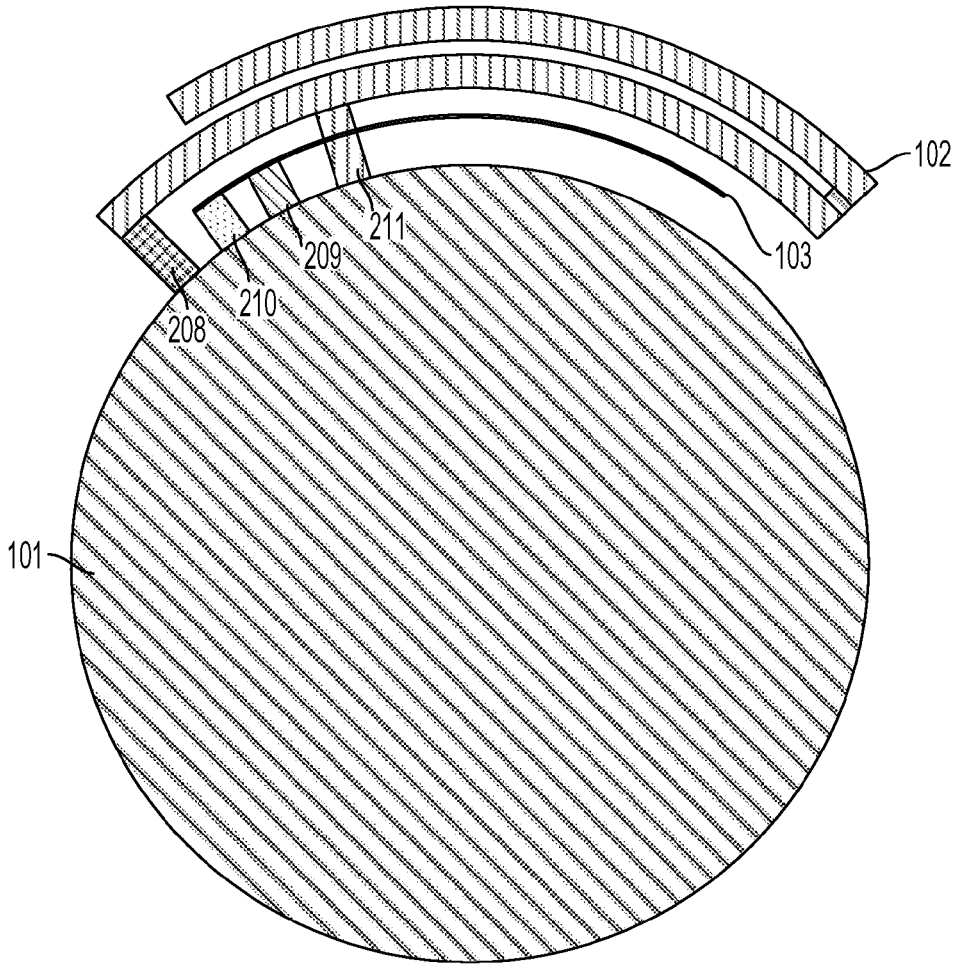
FIG. 10A is a top view of an alternative embodiment multiple antenna system with a printed circuit board having a circular printed circuit board.

FIG. 10A is a top view of an alternative embodiment in which the printed circuit board 101 may be circular in shape. As shown in FIG. 10A, the first antenna 102 may be configured in the same horizontal plane as the printed circuit board 101 and may formed in approximately the same curved shape as the printed circuit board 101. In addition, the second antenna 103 is formed in a plane perpendicular to the plane containing the first antenna 102 and the printed circuit board 101. As shown in the top view of FIG. 10A, the edge of the second antenna 103 is visible. However, the shape of the second antenna 103 may also conform to the shape of the printed circuit board 101. Thus, the edge of the second antenna 103 may be curved to conform to the shape of the printed circuit board 101.

Figure 10B:
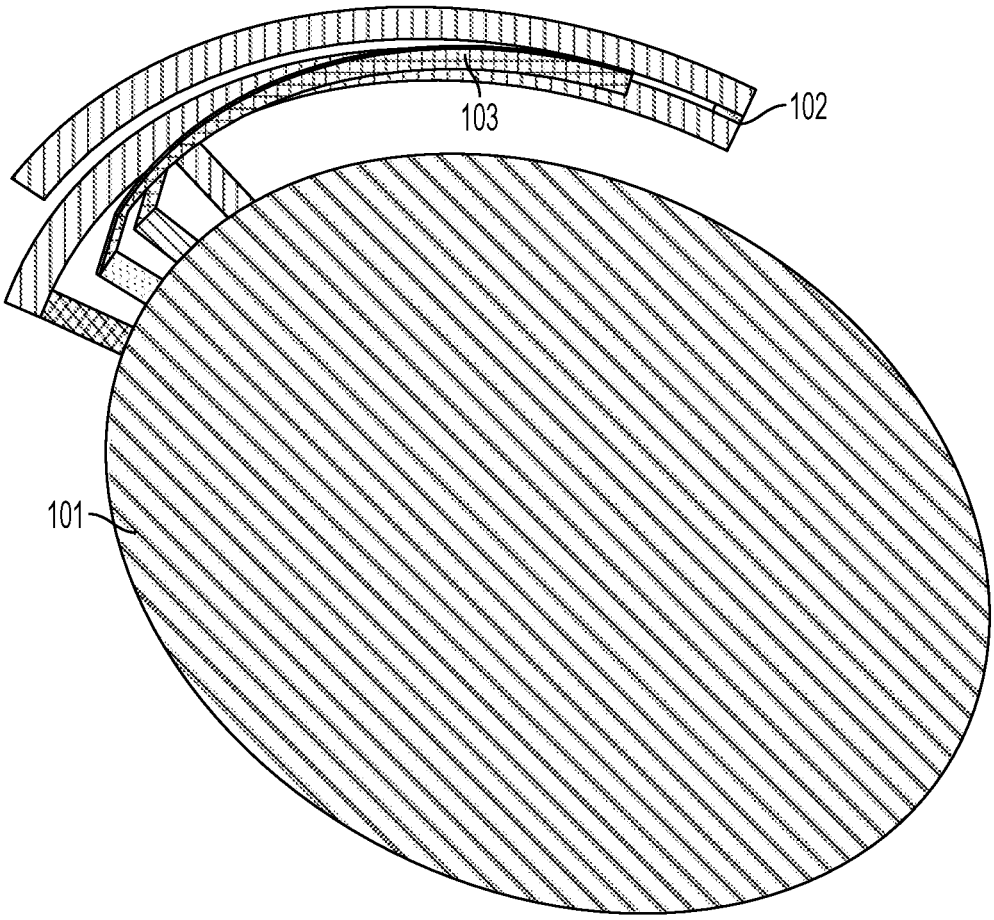
FIG. 10B is a perspective view of an alternative embodiment multiple antenna system with a printed circuit board having a circular printed circuit board.

FIG. 10B is a perspective view of the alternative embodiment shown in FIG. 10A. FIG. 10B illustrates the circular shape of the printed circuit board 101 and the manner in which both the first antenna 102 and the second antenna 103 may conform to the circular shape of the printed circuit board 101.

Figure 10C:
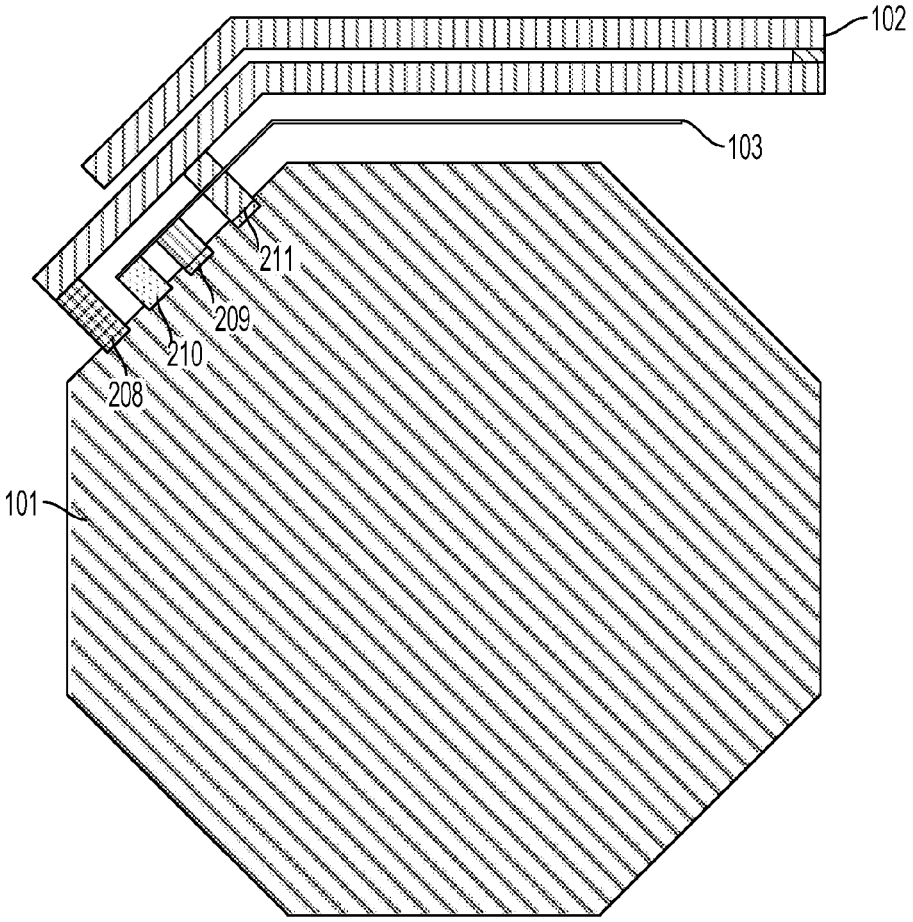
FIG. 10C is a top view of an alternative embodiment multiple antenna system with a printed circuit board having a hexagon shaped printed circuit board.

FIG. 10C is a top view of another example embodiment in which the printed circuit board 101 is hexagonal in shape, although the printed circuit board may a polygon of any number of sides. Again, as with the earlier described embodiments, in the embodiment illustrated in FIG. 10C, the printed circuit board 101 may have a lateral edge and the first antenna 102 may be offset from the lateral edge of the printed circuit board 101 and may be formed in the same horizontal plane as the printed circuit board 101. The second antenna 103 may be formed in a plane perpendicular to the plane containing the printed circuit board 101 formed in a hexagon shape and the first antenna 102 laterally offset from the printed circuit board 101. The first antenna 102 may be coupled to the printed circuit board 101 via a first antenna feed contact 208 and first antenna ground contact 211. The second antenna 103 may be coupled to the printed circuit board 101 via a second antenna feed contact 209 and second antenna ground contact 210. The second antenna feed contact 209 and second antenna ground contact 210 positioned between the first antenna feed contact 208 and first antenna ground contact 211. As shown in FIG. 10C, both the first antenna 102 and edge of the second antenna 103 may conform to the hexagon shape of the printed circuit board 101.

Figure 10D:
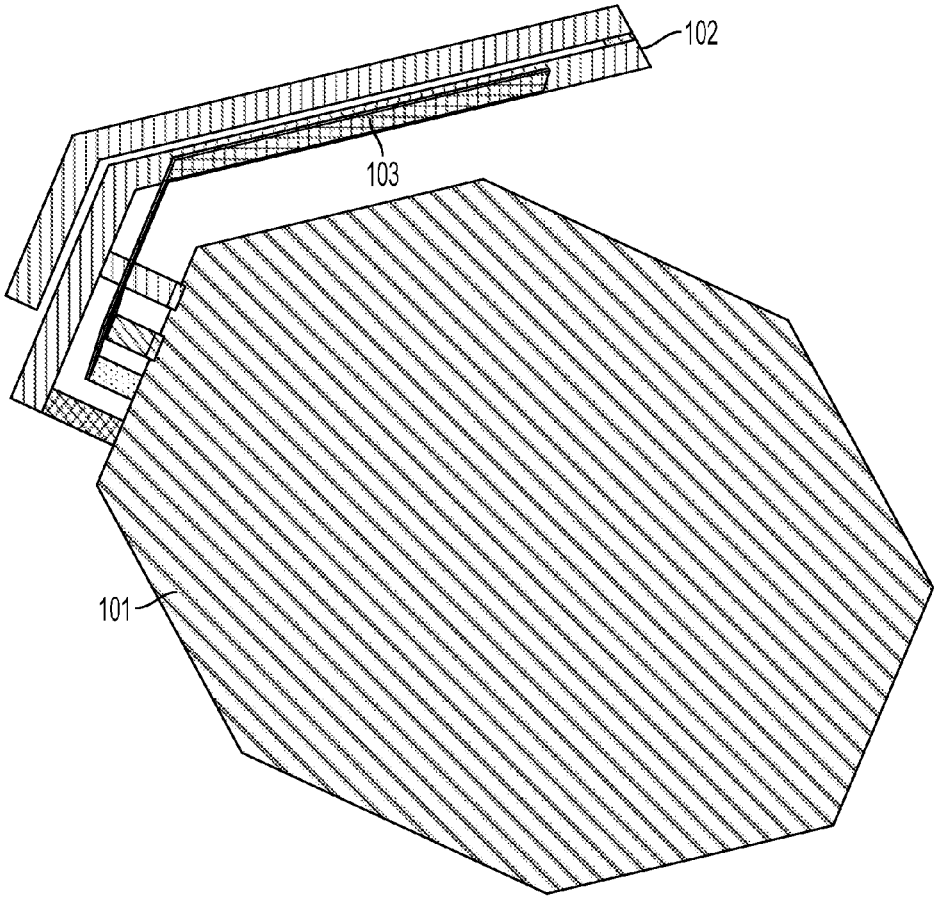
FIG. 10D is a perspective view of an alternative embodiment multiple antenna system with a printed circuit board having a hexagon shaped printed circuit board.

FIG. 10D is a perspective view of the alternative embodiment shown in FIG. 10C. FIG. 10D illustrates the hexagonal shape of the printed circuit board 101 and the manner in which both the first antenna 102 and the second antenna 103 may conform to the hexagonal shape of the printed circuit board 101.

Figure 10E:
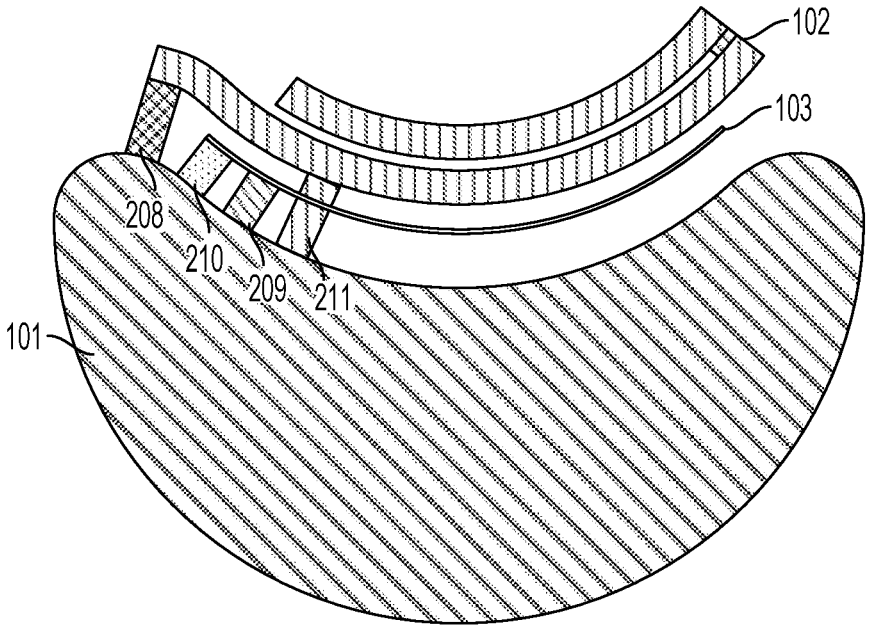
FIG. 10E is a top view of an alternative embodiment multiple antenna system with a printed circuit board having an arbitrarily shaped printed circuit board.

FIG. 10E is a top view of another example embodiment in which the printed circuit board 101 is of an arbitrary shape (e.g., kidney-shaped). Again, as with the earlier described embodiments, in the embodiment illustrated in FIG. 10E, the printed circuit board 101 may have a lateral edge and the first antenna 102 may be offset from the lateral edge of the printed circuit board 101 and may be formed in the same horizontal plane as the printed circuit board 101. The second antenna 103 may be formed in a plane perpendicular to the plane containing the printed circuit board 101 formed in an arbitrary shape and the first antenna 102 laterally offset from the printed circuit board 101. The first antenna 102 may be coupled to the printed circuit board 101 via a first antenna feed contact 208 and first antenna ground contact 211. The second antenna 103 may be coupled to the printed circuit board 101 via a second antenna feed contact 209 and second antenna ground contact 210. The second antenna feed contact 209 and second antenna ground contact 210 positioned between the first antenna feed contact 208 and first antenna ground contact 211. As shown in FIG. 10E, both the first antenna 102 and edge of the second antenna 103 may conform to the arbitrary (kidney) shape of the printed circuit board 101.

Figure 10F:
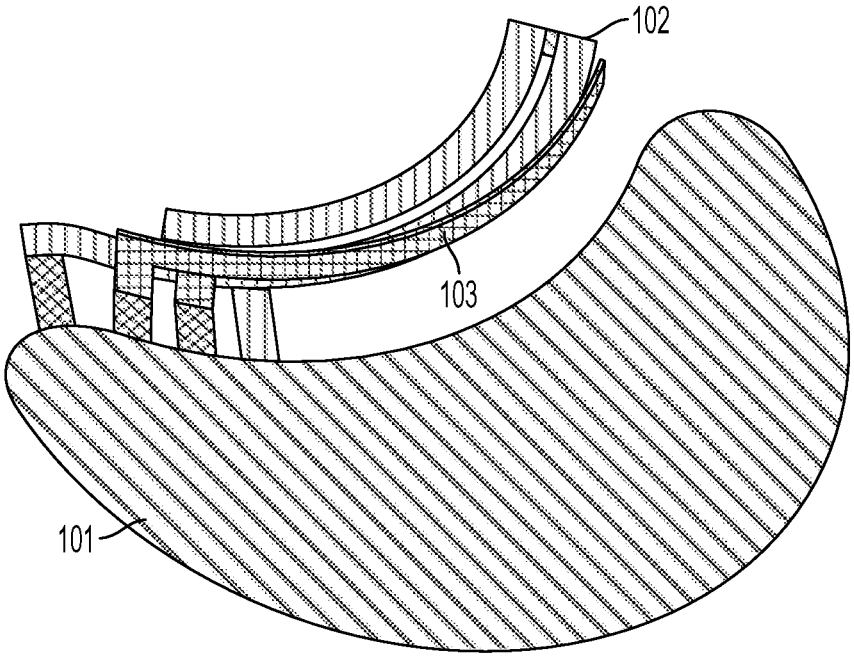
FIG. 10F is a perspective view of an alternative embodiment multiple antenna system with a printed circuit board having an arbitrarily shaped printed circuit board.

FIG. 10F is a perspective view of the alternative embodiment shown in FIG. 10E. FIG. 10F illustrates the arbitrary shape of the printed circuit board 101 and the manner in which both the first antenna 102 and the second antenna 103 may conform to the arbitrary shape of the printed circuit board 101.

Figure 11:
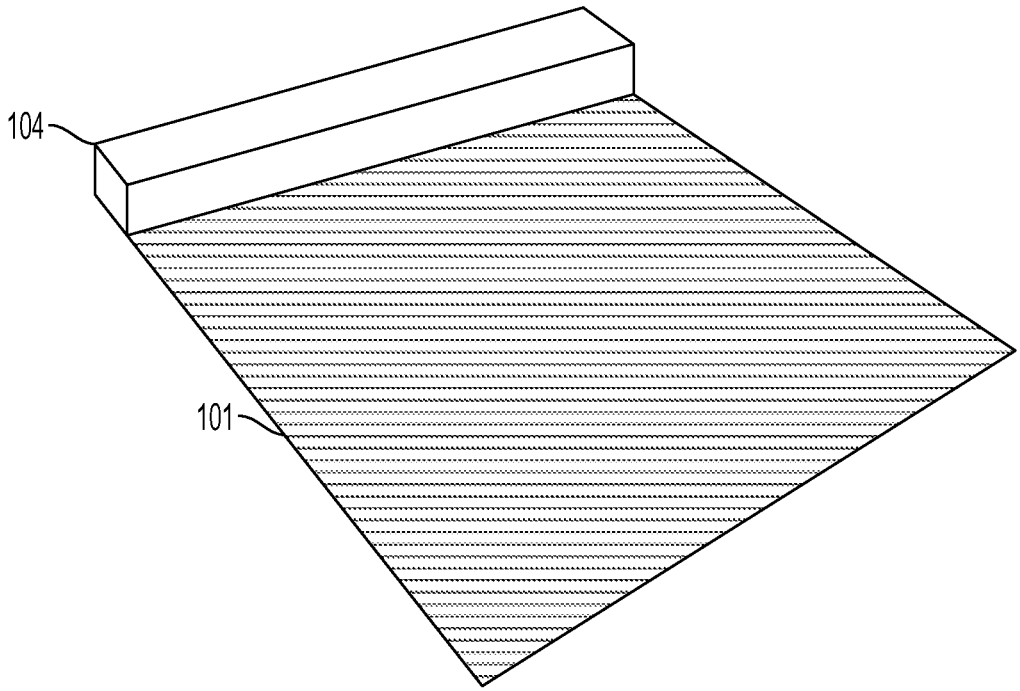
FIG. 11 is a perspective view of an embodiment multiple antenna module containing a multiple antenna system.

FIG. 11 is a perspective view of an embodiment multiple antenna system as a unitary module 104. In the embodiment shown in FIG. 11 a multiple antenna system module 104 contains the first antenna 102 (not shown), second antenna 103 (not shown) and respective ground and feed contacts 208, 209, 210, and 211 (not shown) shown in FIGS. 2-9. The multiple antenna module housing unit 104 may provided additional protection for the first and second antennas 102 and 103 from external environmental conditions such as water, impact, corrosion, etc. In addition, by housing the multiple antenna system in a singular module unit 104, a single unit may be quickly integrated with a printed circuit board 101 to provide wireless capabilities. Additionally, the housing, the first antenna ground contact, the first antenna feed contact, the second antenna ground contact, and the second antenna feed contact are configured to be connected to a printed circuit board by a quick connection, such as pins, clips or other connectors.

In addition, the multiple antenna module housing 104 may be manufactured as an "off the shelf" component that is quickly integrated with an existing printed circuit board. Varying multiple antenna modules 104 may be manufactured that may be used with printed circuit boards 101 of various sizes. As discussed above, in order to operate correctly, the length of the antenna and the printed circuit board 101 acting as the ground plane should be at least one half the wavelength of the transmission wave that the antenna is intended to transmit/receive. Thus, multiple antenna modules 104 may be manufactured for quick integration with printed circuit boards 101 of particular dimensions. In this manner, an "off-the-shelf" multiple antenna system module 104 may be quickly selected and coupled to any printed circuit board 101 to provide wireless functionality.

In alternative embodiments, a multiple antenna module housing 104 having established dimensions may be used with any of a number of printed circuit having varied dimensions. In such embodiments a matching circuit may be incorporated in the multiple module housing 104 or on the printed circuit board 101. The matching circuit may couple the first antenna 102 and second antenna 103 to the circuits housed on the printed circuit board 101. The matching circuit may adjust the resonant frequency of the expected frequency in instances where the total length of antenna (first antenna 102, second antenna 103 or both) and the printed circuit board 101 acting as the ground plane is significantly greater or less than one half the wavelength of the expected frequency. While such embodiments may not provide optimal antenna performance, such as the case where the antenna (first antenna 102 and/or second antenna 103) is properly sized to the dimensions of the printed circuit board 101, such embodiments may still provide effective antenna performance.

When designing antenna it is important to consider an antenna's return loss. Return loss (S11) is a measure of how much energy is reflected by an antenna back toward the device in which the antenna is implemented. When a particular antenna design is implemented in a device and energy is provided to the antenna, one may measure the return loss to determine how efficiently the antenna design is radiating a signal away from the device containing the antenna (and toward a receiving device). The measure of return loss is viewed along a dB scale.

A poorly designed antenna will result in some of the energy provided to the antenna being reflected back to the device containing the poorly designed antenna. As an example, if the antenna is transmitting a radio signal at a particular frequency, but the antenna and ground plane is not configured in length to be approximately a half wavelength of the radio signal at a particular frequency, much of the energy used to transmit the radio signal will be reflected back to the device and the transmitted signal will experience a significant energy loss. Consequently, the range or power of the received signal will be diminished.

In order to design an antenna that may operate across a wide frequency band antenna designers implement antennas of varying shapes, sizes, and configurations. An ideally designed antenna will pass all of the energy provided to the antenna to the receiving device, but this is not possible for wide band antenna. In practice, when viewing the amount of return loss for wide band small antenna, one typically looks to see a measure of return loss to be less than −5 db. If the amount of return loss is less than −5 db across the desired frequency band, the antenna is said to be well designed for that operating frequency band.

Figure 12:
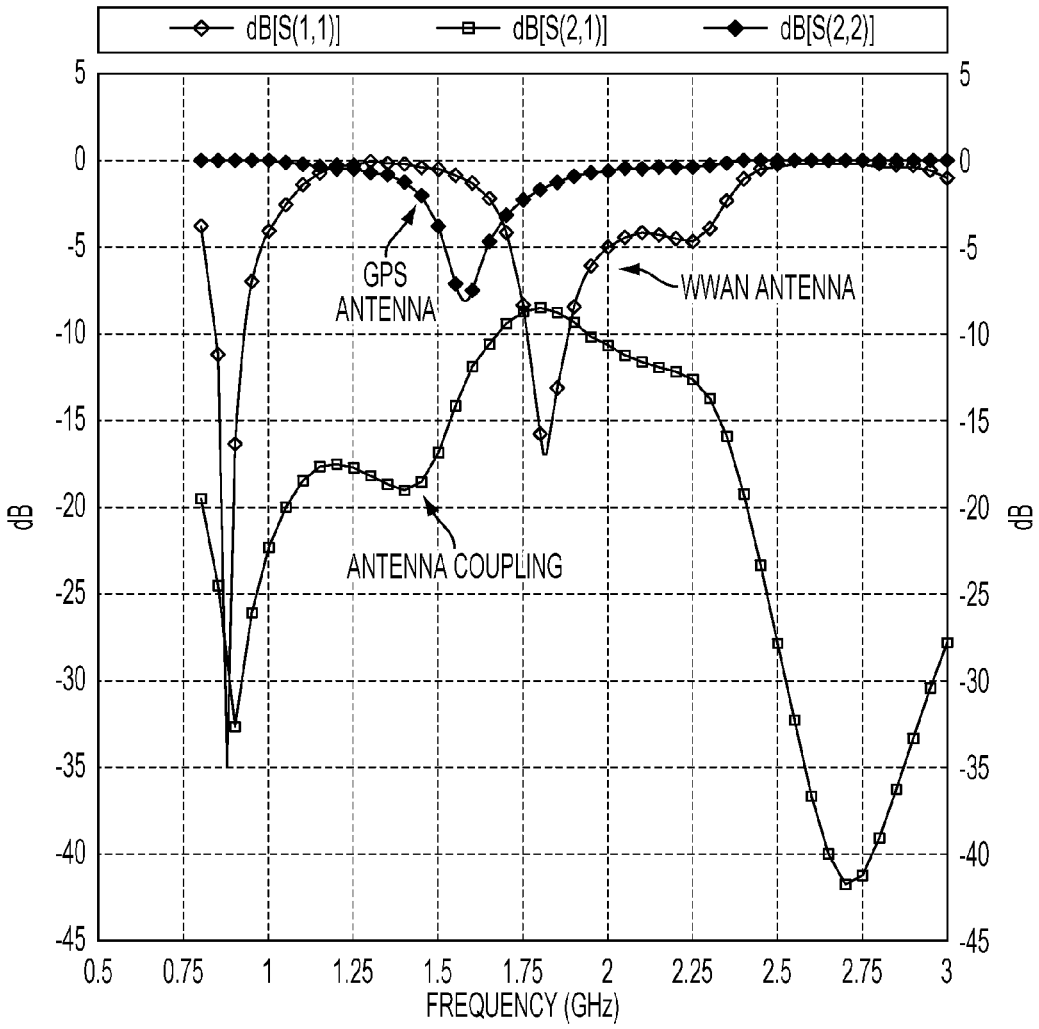
FIG. 12 is a graph of simulation results of an embodiment multiple antenna system.

FIG. 12 is a graph of simulation results of the embodiment multiple antenna system shown in FIGS. 2-9. In a typical GPS receiver, the GPS antenna (e.g., the second antenna 103) may receive RF signals in the frequency band of 1565 MHz to 1610 MHz. In a typical WWAN network, the WWAN antenna (first antenna 102) operates in two frequency bands. The first lower frequency band may be 824 MHz to 960 MHz. The second higher frequency band may be 1710 MHz to 2170 MHz. For a second antenna 103 receiving GPS signals receives in the frequency band of 1565 MHz to 1610 MHz, it is desirable to have less than −5 dB of return loss in that antenna. FIG. 12 shows that over the operating frequency of 1565 MHz to 1610 MHz, the return loss of an embodiment multiple antenna system is significantly lower than −5 dB. The calculated return loss is as low as −7 dB at 1600 MHz. Thus, the second antenna 103 in the embodiment multiple antenna system is well designed for GPS receivers. The simulation results for the first antenna 102 show a calculated return loss well below the −5 dB threshold across the lower frequency band of 824 MHz-960 MHz. Indeed, the calculated return loss is as low as −35 dB within the desired lower frequency band for a WWAN. In addition, FIG. 12 shows that the worst case of the return loss is close to the −5 dB threshold for the higher frequency band of 1710 MHz to 2200 MHz. Thus, the first antenna 102 is well designed for WWAN operation.

To determine the amount of antenna coupling that may exist in a system one may measure the amount of energy imparted on the other antennas in the multiple antenna system when a particular antenna is transmitting. As an example, when the first antenna 102 is transmitting a signal over its desired frequency band, one may measure the isolation S(2,1) between the two antennas 102 and 103. A well designed antenna system will result in a measure of isolation S(2,1) between the two antennas 102 and 103 of less than −10 dB across the entire frequency bands.

FIG. 12 shows that the calculated isolation S(2,1) is less than −10 dB across the operating frequency spectrum for a GPS network (1565 MHz to 1610 MHz). Additionally, in the lower frequency band of a WWAN network, the measure of isolation is well below the −10 dB threshold. For the most part, the embodiment antenna system exhibits a measure of −20 dB or less across the lower frequency band (824 MHz to 960 MHz) of a WWAN network. The antenna design does exhibit a measure of isolation that is greater than −10 dB across a portion of the higher frequency band of a WWAN network (1710 MHz to 2200 MHz). However, such a measure of isolation may be deemed acceptable. At its worst, the calculated isolation is about −8 dB. Such a calculated isolation may be caused by the fact that the first antenna 102 and second antenna 103 in the embodiments shown in FIGS. 2-9 may be configured in such close proximity to one another. In addition, because the dimensions of the printed circuit board 101 may be of such a diminished size, the calculated isolation is further lessened. The calculated isolation may be improved by configuring the second antenna 103 further away from the first antenna 102 in either the vertical plane (increasing the height of the second antenna 103) or horizontal plane (extending the first antenna 102 further from the edge of printed circuit board 101 in horizontal plane while keeping the second antenna 103 in the same location). The simulation results shown in FIG. 12 present calculated results for a worst possible case (i.e., first antenna 102 and second antenna 103 configured in very close proximity and small printed circuit board 101). In implemented designs additional tolerances/dimensions may be implemented while still providing a compact multiple antenna system. Thus, FIG. 12 shows that the multiple antenna system disclosed in the various embodiments is well designed for the application of a watch-sized communication device that is configured to receive GPS signals and communicate via a WWAN network.

The preceding description of the disclosed embodiments is provided to enable any person skilled in the art to make or use the present disclosure. Various modifications to these embodiments will be readily apparent to those skilled in the art, and the generic principles defined herein may be applied to other embodiments without departing from the spirit or scope of the disclosure. Thus, the present disclosure is not intended to be limited to the embodiments shown herein but is to be accorded the widest scope consistent with the following claims and the principles and novel features disclosed herein.

What is claimed is:

1. A wireless device, comprising:

a printed circuit board having an edge;

a first antenna extending beyond the edge of and coplanar with the printed circuit board, the first antenna having a first antenna ground contact and a first antenna feed contact connecting the first antenna to the printed circuit board; and a second antenna positioned perpendicular to the first antenna and connected to the printed circuit board by a second antenna ground contact and a second antenna feed contact, wherein the second antenna ground contact and the second antenna feed contact are positioned between the first antenna ground contact and the first antenna feed contact.

2. The wireless device of claim 1, wherein the first antenna is configured to transmit and receive signals over a first wireless network.

3. The wireless device of claim 2, wherein the first wireless network is a wireless wide area network (WWAN).

4. The wireless device of claim 1, wherein the second antenna is configured to receive signals from a second wireless network.

5. The wireless device of claim 4, wherein the second wireless network is a global positioning system (GPS) network.

6. The wireless device of claim 1, wherein:

the printed circuit board has dimensions of 34 mm by approximately 35 mm;

the first antenna ground contact is connected to the printed circuit board at a first corner of the printed circuit board and has dimensions of approximately 2 mm in width and extends approximately 5 mm to offset the first antenna beyond the edge of the printed circuit board;

the first antenna feed contact is positioned approximately 12 mm away from the first antenna ground contact and has dimensions of approximately 2 ram in width and extends approximately 5 mm to offset the first antenna beyond the edge of the printed circuit board;

the first antenna comprises:

a first segment having dimensions of approximately 27 mm by approximately 2 mm;

a second segment having dimensions of approximately 2 mm by approximately 1 mm; and a third segment having dimensions of approximately 34 rum by approximately 2 mm.

7. The wireless device of claim 6, wherein:

the second antenna ground contact is connected to the printed circuit board proximate to the first corner of the printed circuit board and comprises:

a horizontal ground segment having dimensions of approximately 2 mm in width and extends approximately 3 mm to offset the second antenna beyond the edge of the printed circuit board; and a vertical ground segment having dimensions of approximately 2 mm and extends in a vertical plane to offset the second antenna approximately 3 mm vertically above the plane containing the printed circuit board and the first antenna;

the second antenna feed contact is connected to the printed circuit board proximate to the first corner of the printed circuit board and comprises:

a horizontal feed segment having dimensions of approximately 2 mm in width and extends approximately 3 mm to offset the second antenna beyond the edge of the printed circuit board; and a vertical feed segment having dimensions of approximately 2 mm and extends in a vertical plane to offset the second antenna approximately 3 mm vertically above the plane containing the printed circuit board and the first antenna; and the second antenna comprises a single segment having dimensions of approximately 2 mm by 24 mm.

8. The wireless device of claim 1, wherein the first antenna is configured in length to transmit and receive radio signals over a first wireless network having frequency bands of 824 MHz to 960 MHz and 1710 MHz to 2200 MHz.

9. The wireless device of claim 1, wherein the second antenna is configured in length to receive radio signals of a second wireless network in a frequency band of 1565 MHz to 1610 MHz.

10. The wireless device of claim 1, further comprising a multiple antenna module housing configured to house the first antenna, the second antenna, the first antenna ground contact, first antenna feed contact, the second antenna ground contact and the second antenna feed contact.

11. The wireless device of claim 1, wherein the first antenna is a planar inverted F antenna (PIFA) and the second antenna is a PIFA.

12. The wireless device of claim 1, wherein the printed circuit board has a shape selected from the group consisting of a circle, a semi-circle, a polygon and an arbitrary shape.

13. The wireless device of claim 12, wherein the shape of the first antenna and the second antenna conforms to the shape of the printed circuit board.

14. A compact multiple antenna module, comprising:

a first antenna configured to extend beyond a lateral edge of and coplanar with a printed circuit board, the first antenna having a first antenna ground contact and a first antenna feed contact configured to be connected to the printed circuit board; and a second antenna configured perpendicular to the first antenna and the second antenna having a second antenna ground contact and a second antenna feed contact configured to be connected to the printed circuit board, wherein the second antenna ground contact and the second antenna feed contact are positioned between the first antenna ground contact and the first antenna feed contact.

15. The compact multiple antenna module of claim 14, wherein the first antenna is configured to transmit and receive signals over a first wireless network.

16. The compact multiple antenna module of claim 15, wherein the first wireless network is a wireless wide area network (WWAN).

17. The compact multiple antenna module of claim 14, wherein the second antenna is configured to receive signals from a second wireless network.

18. The compact multiple antenna module of claim 17, wherein the second wireless network is a global positioning system (GPS) network.

19. The compact multiple antenna module of claim 14, further comprising a housing, wherein the first antenna and the second antenna are positioned within the housing.

20. The compact multiple antenna module of claim 19, wherein the housing, the first antenna ground contact, the first antenna feed contact, the second antenna ground contact, and the second antenna feed contact are configured to be connected to the printed circuit board by a quick connection.

* * * * *